US005800254A

United States Patent [19]

Motley et al.

[11] Patent Number: 5,800,254

[45] Date of Patent: Sep. 1, 1998

[54] AUTOMATIC APPARATUS FOR GRINDING AND POLISHING SAMPLES

[75] Inventors: Charles B. Motley, McHenry; Dennis L. Hechel, Gurnee, both of Ill.

[73] Assignee: Buehler Ltd., Lake Bluff, Ill.

[21] Appl. No.: 625,290

[22] Filed: Apr. 1, 1996

[51] Int. Cl.[6] ..... B24B 7/22

[52] U.S. Cl. ..... 451/285; 451/287; 451/339; 414/225

[58] Field of Search ..... 451/41, 285, 286, 451/287, 288, 289, 66, 67, 339; 414/222, 225

[56] References Cited

U.S. PATENT DOCUMENTS 4,680,893 7/1987 Cronkhite et al. ..... 451/41
4,771,578 9/1988 Jorgensen et al. ..... 51/165.77
4,873,792 10/1989 Linke et al. ..... 51/165.8
5,660,581 8/1997 Shin et al. ..... 451/289
5,679,060 10/1997 Leonard et al. ..... 451/41

*Primary Examiner*—Eileen P. Morgan
*Attorney, Agent, or Firm*—Banner & Witcoff Ltd

[57] ABSTRACT

An automatic sample preparation system for polishing and grinding metallurgical and other samples prior to microscopic examination of the samples, including a rack which holds a plurality of abrasive platens, and platen transfer mechanism for selecting one platen from the rack and transferring the same to a platen drive plate for a polishing operation and for later returning the platen to the rack and transferring another selected platen to the platen drive plate, and a polishing head which can be rotated between a polishing position for polishing samples and a wash position where it is over a wash and dry station, the platen transfer mechanism being operated when the polishing head is rotated to its wash position.

11 Claims, 5 Drawing Sheets

FIG.6
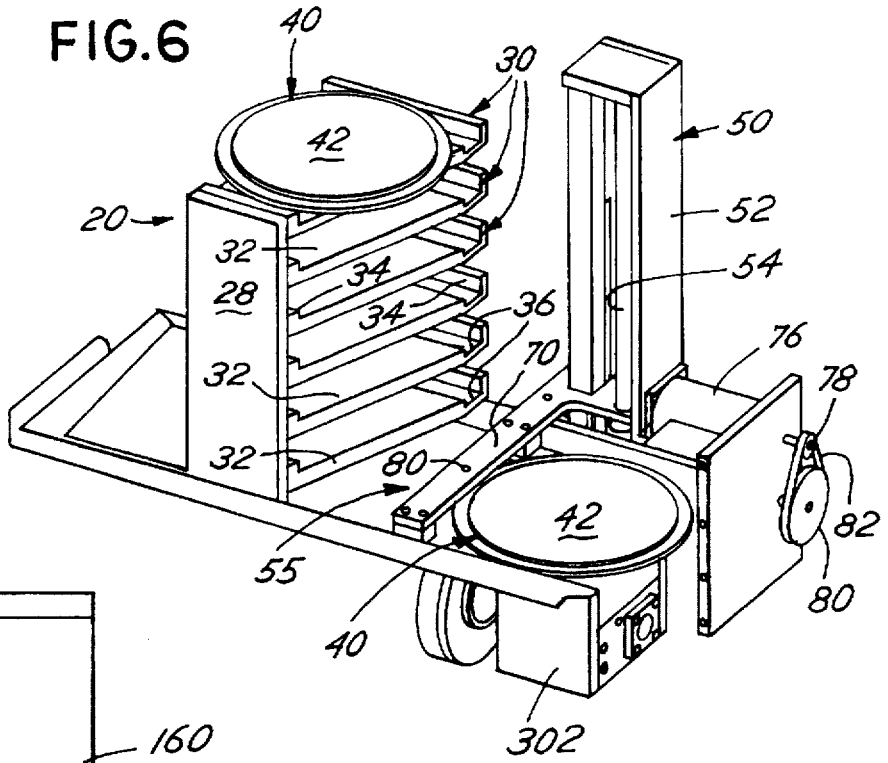
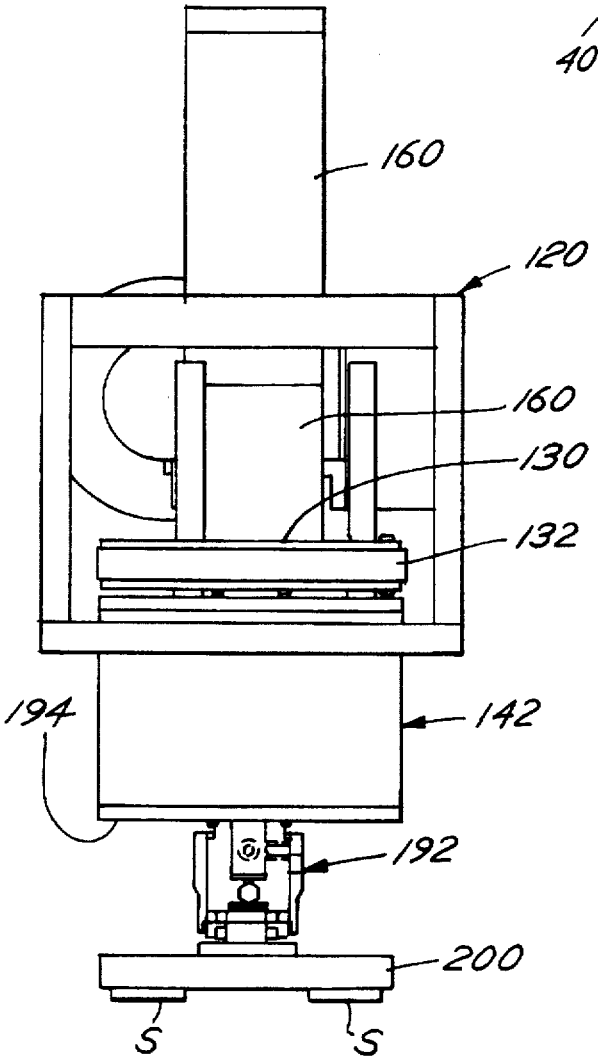
FIG. 5

AUTOMATIC APPARATUS FOR GRINDING AND POLISHING SAMPLES

BACKGROUND OF THE INVENTION

The present invention relates to the preparation of samples for microscopic examination. Metallurgical and other samples are normally ground and polished to prepare them for microscopic examination. It is known in the art to cut such samples and mount them in a suitable mount for ease of handling during the preparation thereof and for the microscopic examination of such samples.

It is also known to provide a drive plate on which a platen is mounted for rotation, and to provide an abrasive surface on the top of such a platen. Mechanism is also known including a sample holder which will hold a plurality of samples and position them against the top of a rotating platen for grinding or polishing the samples. The particular fineness of the abrasive surface on the top of the platen will determine the fineness of the grinding or polishing operation. In carrying out such operations, it is known to rotate both the sample holder and the platen, and they may be rotated in opposite directions.

The present invention may be practiced using known platens with known abrasive surfaces thereon, and using known sample holders which hold a plurality of samples against the top surface of a platen for grinding or polishing the samples, while both the sample holder and the platen rotate. However, the present invention is directed to improved mechanism which will automatically load one platen after another on a drive plate so that platens having abrasive surfaces of varying coarseness or fineness may be used in sequence to polish a plurality of specimens without need for an operator to change the platens for each new grinding or polishing operation.

It is a further object of the present invention to provide apparatus which will move a sample holder to a wash station after a polishing or grinding operation and will remove a platen from the drive plate and substitute a different platen on the drive plate while the samples are being washed and dried in preparation for the next polishing operation.

The foregoing and other objects and advantages of the invention will be apparent from the following description of certain preferred embodiments thereof, taken in conjunction with the accompanying drawings.

DESCRIPTION OF THE DRAWINGS

FIG. 5 is a partial elevational view which shows an alternative mode of operation to the showing in FIG. 4 where the polishing head is moved down to simultaneously apply downward pressure to a sample holder containing a plurality of samples rather than apply pressure individually to such samples; and FIG. 6 is a front perspective cutaway view showing a platen transfer arm in its lowest position and aligned with a platen drive plate after loading a selected platen onto the drive plate in preparation for a polishing operation.

Now, in order to acquaint those skilled in the art with the manner of making and using my invention, I shall describe, in conjunction with the accompanying drawings, a preferred embodiment of my invention.

DETAILED DESCRIPTION OF THE INVENTION

Figure 1:
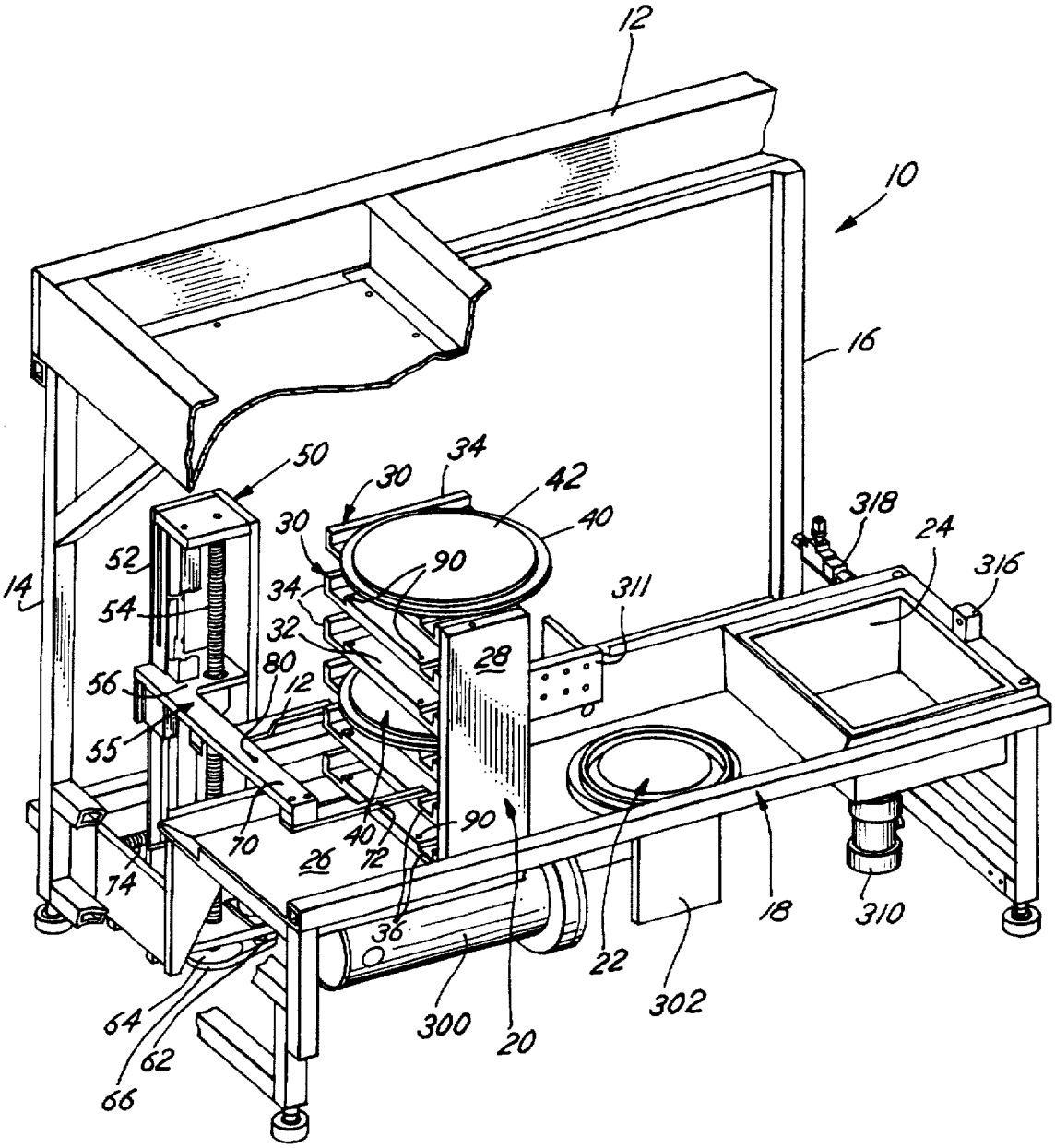
FIG. 1 is a perspective front view of an automatic sample preparation apparatus constructed in accordance with the present invention, the housing being broken away to illustrate the components, and the view showing a rack for supporting a plurality of platens one above the other, and showing mechanism for transferring one platen at a time to a drive plate at a polishing station, there being eliminated from the view apparatus for supporting and rotating specimens during a polishing operation.

FIG. 1 shows a frame generally indicated at 10 which is cut away to better illustrate the interior components. The frame includes a top frame portion 12, upright post members 14 and 16, and a front, lower frame portion 18 which supports a platen rack or storage member 20, a platen drive plate 22 and a wash tank 24. The entire sample preparation system may be completely enclosed in a housing, although preferably a front portion of the enclosure will be transparent so that an operator can observe various polishing operations as they occur.

The frame 10 includes a floor 26 on which the platen rack or storage member 20 is supported. In the embodiment being described, the platen storage member includes a single upright support wall 28, and there are six horizontal shelf members 30, each having one end affixed to the wall 28 to be supported in cantilever fashion. The six shelf members 30 are arranged vertically one above the other, and each is intended to support a platen having a selected degree of fineness for a desired polishing or grinding operation.

As shown in FIGS. 1 and 6, each shelf 30 has a flat bottom wall 32 or support surface on which a given platen rests when being stored in the rack 20. Each shelf has opposed upstanding end walls 34, the end wall located at one end being used to attach the shelf 30 to the support wall 28. In addition, at each end of each support surface 32 a slot or trough 36 is formed, and as will be described hereinafter, such slots 36 serve to accommodate lift arms which are part of the platen transfer mechanism.

In FIG. 1, a metal platen 40 having an abrasive top surface 42 is shown resting on the bottom wall or support surface 32 of the uppermost shelf 30, and a similar platen 40 is shown resting on the third shelf from the bottom. The apparatus is designed to store six different platens having different abrasive top surfaces. The support wall 28 is fixedly secured to the frame 18 at its lower end to firmly support the several platen shelves 30.

FIG. 1 further shows a platen exchange mechanism 50 including an upright generally rectangular frame 52 and a vertically mounted feed screw 54. A platen exchange arm 55 includes a horizontal support plate 56 at one end which has the vertical feed screw 54 passing thereto and threaded to plate 56 so that rotation of feed screw 54 will move plate 56 and platen transfer arm 55 vertically in either direction. The frame 52 has square side walls which fit closely around the support plate 56 on at least two sides thereof and in that manner they guide the support plate 56 and maintain the orientation of the platen exchange arm 55.

Rotation of the vertical feed screw 54 is effected by a motor 60 (see FIG. 2) through pulleys 62 and 64 and belt 66 (see FIG. 1), the pulley 64 being connected to the lower end of the screw. Motor 60 serves to rotate vertical feed screw 54 in either direction to raise and lower platen exchange arm 55. Platen exchange arm 55 includes a main support arm 70 having a pair of spaced lift arms 72, and it is the arms 72 which support a platen 40 when the same is being transferred from one position to another.

Figure 2:
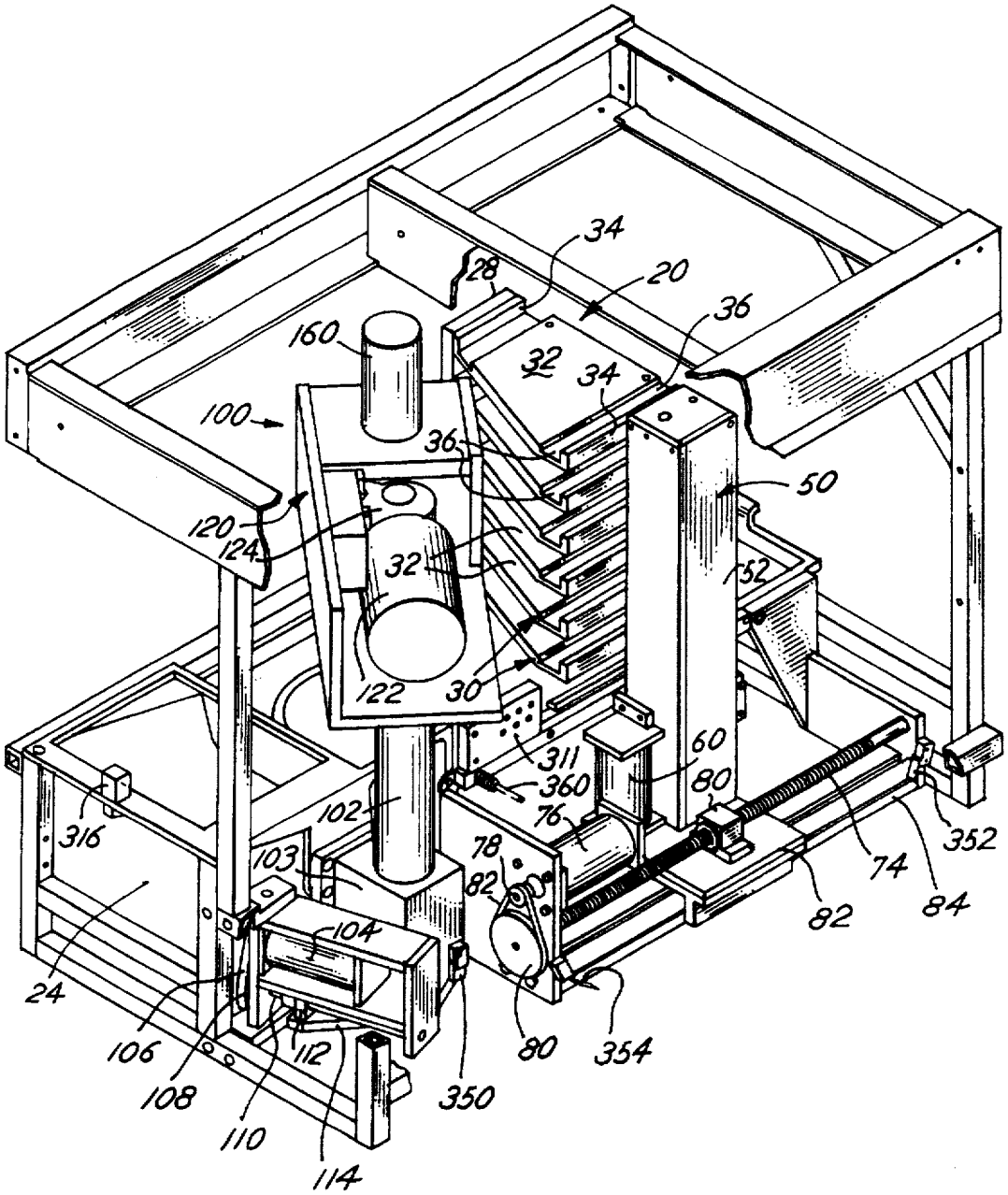
FIG. 2 is a perspective view from the rear which further shows a polishing head and polishing head rotation mechanism, the head being shown in a polishing position.

The platen transfer arm 55 is movable horizontally as well as vertically through horizontal movement of the platen exchange mechanism 50 on a horizontal lead screw 74 as best shown in FIG. 2. A motor 76 operates through pulleys 78 and 80 and belt 82 to rotate horizontal screw 74, and the screw passes through a bearing block 80 attached to the top of a bearing carriage 82 on which the platen exchange mechanism 50 is mounted. The carriage 82 is guided for horizontal movement on a base 84 which may be considered part of the frame 10.

FIG. 1 shows the platen exchange arm 55 in a retracted position where the two lift arms 72 are behind or to the left of the platen rack 20. The vertical position of the platen exchange arm 55 is adjustable when the arm 55 is retracted horizontally as shown in FIG. 1 because the lift arms 72 will clear the platen storage rack 20. As a result, vertical motor 60 (see FIG. 2) is operated to adjust the height of platen exchange arm 55 to a desired level so the arms 72 may move to the right in FIG. 1 and slide through corresponding slots or troughs 36 which underlie the side edges of a platen 40 to be transferred, such side edges extending beyond the support surface 32 to overlie the slots or troughs 36. Therefore, the arms 72 may be moved immediately beneath the opposed side edges of a platen 40 to be transferred.

FIGS. 1 and 6 show a vertical pin 80 which is located near the middle of the support arm 70 and projects downwardly therefrom. As a result, as the platen transfer arm 55 moves to the right as shown in FIG. 1, causing the two lift arms 72 to move under opposite side edges of a platen 40, the depending pin 80 will engage the rear of the platen and push the latter off the support surface 32 so it is supported entirely on the lift arms 72.

Thereafter, the platen transfer arm 55 is moved to the right as viewed in FIGS. 1 and 6 by operation of motor 76 (see FIG. 2) which rotates horizontal lead screw 74 and thereby moves the entire platen transfer mechanism 50 to the right to a forward position as shown in FIG. 6 where a platen 42 is aligned with platen drive plate 22 (see FIG. 1).

The vertical lead screw (54 in FIG. 1) is then again operated to lower the platen transfer arm 55 to its lowermost position as shown in FIG. 6 so a platen 40 is lowered to be supported on the drive plate 22. It is known in the art and will not be described herein, to provide interlocking means between a platen 40 and the drive plate 22 so that the platen will be fixed relative to the drive plate and will rotate conjointly therewith.

When it is desired to return a platen 40 from the polishing position shown in FIG. 2 to the storage rack 20, the vertical feed screw 54 is operated to raise the platen 40 to the desired height corresponding to the shelf 30 on which it is to be stored, and then the horizontal lead screw 74 is operated to move the platen exchange arm 55 from the forward or right-hand position of FIG. 6 to the retracted or left hand position of FIG. 1.

FIG. 1 shows that each shelf support surface 32 has a pair of spaced upwardly projecting pins 90 so that as the platen transfer arm 55 moves to the left-hand or retracted position of FIG. 1, the leading or rear edge of the platen 40 will engage the two pins 90 and be stopped for storage on a given support surface 32, while the platen exchange arm 55 continues moving to its fully retracted position shown in FIG. 1.

Figure 3:
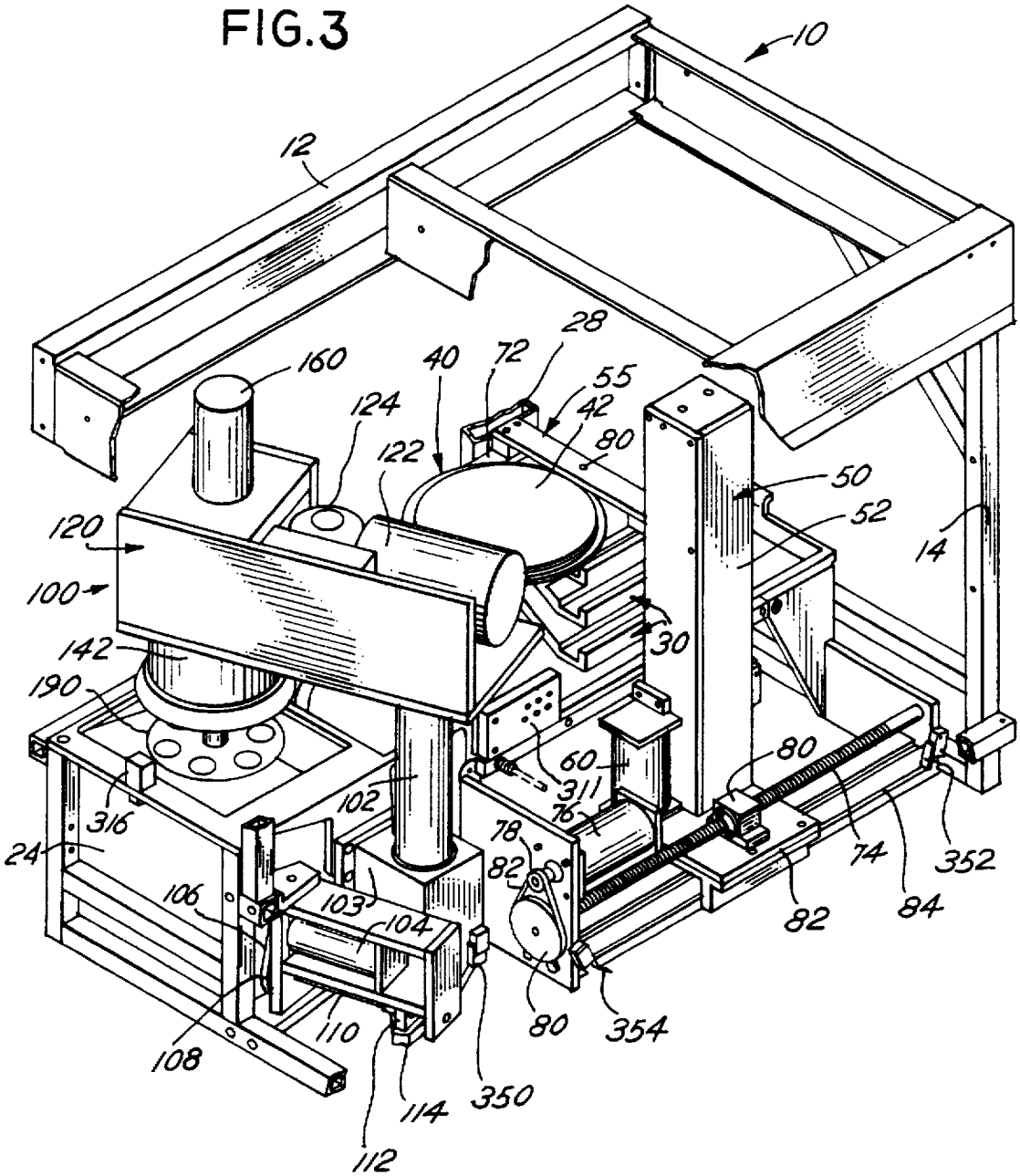
FIG. 3 is a perspective view similar to FIG. 2 but showing the polishing head rotated to a position over a wash tank and showing platen transfer mechanism in the process of loading a platen on a platen storage rack.
Figure 4:
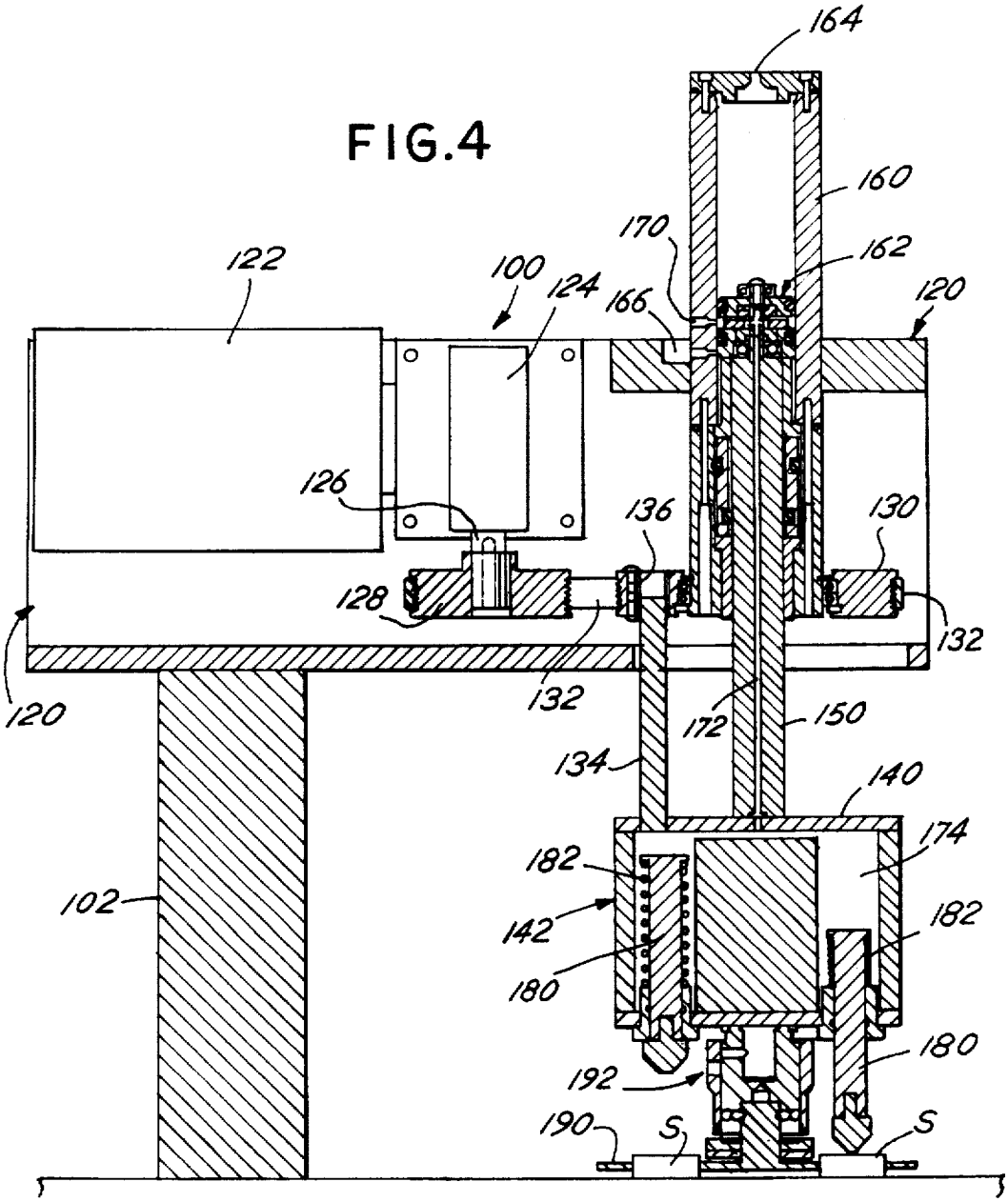
FIG. 4 is a partial vertical section showing a polishing head and related apparatus for raising and lowering the polishing head, apparatus for rotating the polishing head, and mechanism for applying downward pressure to individual samples held in a sample holder for pressing such samples down on the abrasive top surface of a platen which is not shown.

Reference is now made to FIGS. 2–4 which show a polishing head generally indicated at 100. The polishing head is supported on a shaft 102 which is rotatable in a post bearing block 103 to swing the polishing head between a polishing position as shown in FIG. 2 and a wash position as shown in FIG. 3. Thus, in the FIG. 2 position of the head, a plurality of samples may be polished by a platen 40 positioned on drive plate 22 in a polishing position as shown in FIG. 6. In the wash position of FIG. 3, a plurality of samples may be processed in a wash cycle in wash tank 24 while, a different platen 40 is being transferred to the drive plate 22 for the next polishing operation.

FIGS. 2 and 3 in the lower left-hand corner show mechanism for rotating the polishing head 100. A motor 104 drives a pulley (not shown) which operates a belt 106 to drive a second pulley 108. The pulley 108 rotates a lead screw 110 which is threaded through a nut 112 attached to a pivotable lever 114. In the foregoing manner, the motor 104 causes nut 112 to move along screw 110 which in turn pivots lever 114 in a clockwise or counterclockwise direction. The lever 114 is connected to the lower end of shaft 102 to function as a crank to rotate the shaft.

FIG. 2 shows the nut 112 at the left end of the feed screw 110 so lever 114 is in its clockwise position and the polishing head 100 is in its clockwise or polishing position as shown in FIG. 2. FIG. 3 shows the nut 112 at the right end of the feed screw 110 so lever 114 is in its counterclockwise position and the polishing head 100 is in its counterclockwise position over the wash tank 24. In the foregoing manner, the polishing head 100 is positioned over the platen drive plate 22 (see FIG. 1) for polishing a plurality of samples, and after a polishing operation, the polishing head 100 is rotated over the wash tank 24 so the samples may be processed in a wash and dry cycle.

Reference is again made to FIGS. 2–4 to describe the polishing head 100. The upper end of polishing head 100 includes a support frame 120 on which is mounted a motor 122. As best shown in FIG. 4, a gear box 124 is driven by motor 122 and has a shaft 126 projecting from its lower end which rotates a drive pulley 128. The pulley 128 drives a second pulley 130 through a belt 132.

As shown in FIG. 4, the driven pulley 130 has three drive pins 134 (only one being shown) which extend vertically up through holes 136 in the pulley 130. Thus, the upper end of each of the three drive pins 134 extends through a hole 136 formed in the driven pulley 130, and those drive pins can move up through those holes as will be described herein. The lower end of each of the three drive pins 134 extends into a top wall 140 (see FIG. 4) in a manifold 142. The lower ends of drive pins 134 are fixed relative to the manifold top wall 140 so as the manifold 142 moves up and down, the pins 134 move therewith, and such pins can move up and down in the holes 136 in the drive pulley 130.

The manifold 142 is shown in its lowermost polishing position in FIG. 4 where a plurality of samples are polished, and it is movable upwardly from that position to a raised or retracted position as shown in FIG. 5 where the samples are raised above a polishing platen as when the head 100 is to be swung over the wash tank 24 to the FIG. 3 position for a wash and dry cycle.

The manifold 142 is supported on a shaft 150 (see FIG. 4) which is moved up and down to raise and lower the manifold 142. The upper end of shaft 150 is slidable up and down in an air cylinder 160 which is fixed relative to the polishing head frame 120. A plunger assembly 162 is mounted on the upper end of shaft 150 for sliding movement in the air cylinder 160. An air inlet 164 at the top of air cylinder 160 is used to admit air under pressure to move shaft 150 and manifold 142 downwardly to the polishing position shown in FIG. 4. A second air inlet 166 is provided to supply air under pressure to the air cylinder 160 to raise shaft 150 and manifold 142 from the polishing position of FIG. 4 to a raised or retracted position as shown in FIG. 5.

A third air inlet 170 is provided in the side of air cylinder 160 to transmit air under pressure to a center passage 172 which extends vertically down through shaft 150 and leads into an air chamber 174 in the manifold 142. When air under pressure enters air chamber 174, six piston members 180 housed in that chamber are forced downwardly against the action of springs 182. However, the air cylinder 160 and air inlet 170 are designed so that air under pressure from inlet 170 will pass down through passage 172 into the air chamber 174 only when the manifold 142 is in its lowermost polishing position as shown in FIG. 4. It is not desirable that the pistons 180 should be forced to their down position unless the manifold 142 is in a polishing position.

The purpose of the individual pistons 180 in FIG. 4 is to apply a downward force to individual samples to press them down against an abrasive top surface 42 of a polishing platen 40. FIG. 4 shows a sample holder 190 which is known in the art and generally comprises a disc shaped member having a plurality of circumferentially spaced round openings for holding samples S. FIG. 4 does not show a polishing platen 40, but such a platen is shown in other views such as FIG. 6, and it should be understood that the sample holder 190 in FIG. 4 is positioned immediately above such a platen 40 which has an abrasive top surface 42 for grinding or polishing such samples.

It is common to provide six openings in the sample holder 190 so that six samples may be polished simultaneously. It is also known to provide small O-rings (not shown) in the openings of the sample holder for the purpose of retaining samples S in such openings. Such O-rings will retain the samples S in the sample holder 190 so they will not fall out when the sample holder is raised along with the manifold 142 at the end of a polishing operation.

If the sample holder 190 is designed to hold six samples S to be polished, then six of the pistons 180 are provided, one arranged above each sample S. Each of the pistons 180 is biased by a spring 182 to an upper position as shown on the left side of the manifold 142 in FIG. 4. When air under pressure is admitted to air chamber 174, each of the six pistons 180 is forced to its downward position as shown on the right side of the manifold 142 in FIG. 4. It should be understood that all six pistons are moved down together and they retract together when air under pressure is released from chamber 174.

An alternative arrangement is shown in FIG. 5 where a different type of sample holder 200 is used for holding samples S. FIG. 5 shows the manifold or head 142 in its raised position so that shaft 150 is not visible. As in FIG. 4, a sample holder chuck assembly 192 is carried by the bottom 194 of the manifold 142 and serves to support the sample holder 200. Moreover, the sample holder chuck assembly 192 is fixed to the manifold 142 for conjoint rotation with the latter so that a sample holder may be rotated during a polishing operation.

In the embodiment of FIG. 5, a known type of sample holder 200 is used where a plurality of samples S are fixed relative to the sample holder and project beneath the latter so they may contact a polishing platen 40, 42. In FIG. 5, the samples S may be locked in position by screws and related locking members (not shown) as is known in the art so that six samples S may be locked in the sample holder and may be pressed down against a polishing surface by simply lowering the manifold 142 without need for use of the individual pistons shown at 180 in the FIG. 4 embodiment.

In the FIG. 4 embodiment, each sample S is individually pressed down against a polishing surface by a corresponding piston 180, while in the FIG. 5 embodiment such pistons are not utilized and instead a plurality of samples are pressed down against a polishing surface by simply moving the manifold 142 together with the sample holder chuck assembly 192 and sample holder 200 downwardly thereby simultaneously pressing all six samples against the polishing surface.

It is an advantage of the present invention to provide the two different embodiments described above. If the sample holder shown at 200 in FIG. 5 is to be filled with samples, e.g., six samples, then the FIG. 5 embodiment is satisfactory and all samples will be uniformly pressed against a polishing surface. However, such an embodiment will not produce optimum results if less than six samples are being polished because in that situation the sample holder 200 will not be stabilized and may be caused to tilt due to uneven distribution of samples therein. While it is possible in such cases to use dummy samples to fill the sample holder, it is preferred in such situations to use the embodiment of FIG. 4.

In FIG. 4, it does not matter if less than the full complement of six samples S are mounted in the sample holder 190 because each sample is individually pressed against the polishing surface by a corresponding piston 180. If a particular opening in the sample holder does not contain a sample, the corresponding piston 180 will move down and bottom out, so it will not engage the polishing surface. Accordingly, the embodiment of FIG. 5 is entirely satisfactory when a sample holder is to be filled with samples, but the embodiment of FIG. 4 is preferred if less than a full set of samples is to be polished in a given polishing operation.

A cycle of operations for the automatic sample preparation machine will now be described. An operator will fill one of the sample holders 190 (FIG. 4) or 200 (FIG. 5). For purposes of illustration, it will be assumed that the sample holder 190 is supplied with a desired number of samples S up to the maximum number of six samples, and the samples will be held in the sample holder openings by small O-rings (not shown) as known in the art.

The motor 104 (see FIGS. 3 and 4) will be operated to rotate shaft 102 to swing polishing head 100 in a counterclockwise direction to its position over the wash tank 24 as shown in FIG. 3 which is considered the normal starting position. In the foregoing manner, the polishing head 100 will be out of the way so that a platen 40 can be loaded on the drive plate shown at 22 in FIG. 1. It will be assumed that the frame 50 of the platen transfer mechanism is in its fully retracted or left-hand position as shown in FIG. 1 and if necessary the motor 76 will be used to rotate horizontal feed screw 74 to bring it to that position.

Still referring to FIG. 1, the platen transfer arm 55 will be moved to a desired vertical height depending upon which of six vertically stacked platens 40 in the platen rack 20 is to be selected. Such vertical movement of arm 55 is achieved by operating motor 60 (see FIG. 2) to operate lead screw 54

(see FIG. 1) to move plate 56 and arm 55 to a desired elevation. Thereafter, motor 76 is operated to drive horizontal lead screw 74 to move the transfer mechanism 50 from the retracted position of FIG. 1 to the advanced or right-hand position of FIG. 6 (although it will not yet be in the lowered position shown in FIG. 6).

As the transfer arm passes over one of the shelves 30 (see FIG. 1), lift arms 72 will pass under the opposite side edges of a selected platen 40, and when the pin 80 engages the rear of the platen it will push the same off the support surface 32 so it is fully supported on the lift arms 72. The frame 50 will now be in its advanced position of FIG. 6, and it is only necessary to operate motor 60 and vertical feed screw 54 to lower transfer arm 55 to its lowermost position as shown in FIG. 6 where a selected platen 40 will be placed on the drive plate 22 (see FIG. 1) and will be locked to the drive plate for conjoint rotation therewith. In the lowermost position of transfer arm 55 as shown in FIG. 6, it will not interfere with the rotation of drive plate 22 which has a platen 40 mounted thereon.

The next step is to operate motor 104 (see FIGS. 2 and 3) to rotate shaft 102 clockwise and swing polishing head 100 to its clockwise position shown in FIG. 2 where it is located over drive plate 22 which has a platen 40 positioned thereon. Referring now to FIGS. 4 and 5, air under pressure will be admitted to air inlet 164 (see FIG. 4) at the top of air cylinder 160 to move manifold 142 from its raised position of FIG. 5 to its lowered polishing position of FIG. 4, a sample holder 190 with samples S previously having been attached to the sample holder chuck assembly 192 as shown in FIG. 4.

Rotation of manifold 142 is achieved through motor 122 as shown in FIG. 4, and rotation of drive plate 22 and a platen 40 mounted thereon is effected by a motor shown at 300 in FIG. 1 which operates through a gearbox 302 (see FIGS. 1 and 6). Accordingly, the drive plate 22 with a platen 40 is rotated in a counterclockwise direction, and the manifold 142 with a sample holder 190 are rotated in a selected direction to achieve polishing of several samples S.

Because we have assumed sample holder 190 is being used, the six pistons 180 will be moved to their operative positions as shown at the right side of the manifold 142 in FIG. 4 so that each piston 180 will engage at its lower and against the top of a corresponding sample S and apply a predetermined amount of pressure to force the sample against the top of the platen 40 (not shown in FIG. 4, but shown for example in FIG. 6). Prior to the foregoing, the manifold 142 and platen 40 will be rotated. Of course, at least one of the members 142 and drive plate 22 (FIG. 1) must be rotated to effect polishing of samples, but both may be rotated and they may be rotated in the same or opposite directions.

At the end of a polishing operation, it will be assumed that a further polishing cycle is desired with a platen 40 having a different degree of fineness. Normally, the rough grinding steps are carried out first, and the finest polishing is carried out later. In order to carry out the next polishing step, air under pressure is admitted to air inlet 166 in FIG. 4 to raise manifold 142 to its raised position shown in FIG. 5, and air is released from air chamber 174 so that the upwardly biased pistons 180 will return to their upper positions. The polishing head 100 is then swung over the wash tank 24 by operating motor 104 to rotate shaft 102 in its counterclockwise direction until polishing head 100 is in the position shown in FIG. 2.

In the latter position of sample holder 190, which is still rotating, air is again admitted to air inlet 164 to lower manifold 142 and thereby lower specimen holder 190 into the wash tank 24. Different types of wash and dry cycles may be used. By way of example, a wash tank drain valve shown at 310 in FIG. 1 may be closed and the tank 24 filled with water from a water inlet (not shown). The rotating sample holder 190 is lowered into the water, and if desired an ultrasonic cleaner (not shown) may be activated to effect cleaning of the samples. Valve 310 may then be opened to drain the tank 24, a water spray (not shown) may be used to rinse the samples, and then the samples are dried. FIG. 1 shows an air dry nozzle 316 and an air heater housing 318 so that heated air may be supplied to dry the samples. If ultrasonic cleaning is not desired, one may provide simply for rinsing and drying of the samples during the wash cycle.

As the foregoing wash cycle is being carried out, the platen transfer mechanism 50, 55 is used to return the prior platen 40 to the platen rack 20 and select a new platen which is then transferred to rest on the platen drive plate 24. Thus, at the end of a wash and dry cycle, during which a newly selected platen 40 has been removed from rack 20 and placed in polishing position on the drive plate 22, the manifold 142 may be swung clockwise back to its polishing position of FIG. 3 and lowered to carry out the next polishing operation.

It is known in the art to spray certain types of fluids on the polishing surface 42 of a platen 40 for purposes of a polishing operation. FIGS. 1–3 show a slurry/lubricant dispense nozzle manifold 311. One may provide six different hoses (not shown) for the six different openings in the manifold so an operator may select a desired slurry.

As for the wash cycle, various options are available. One may provide ultrasonic cleaning or non-ultrasonic cleaning, and one may use warm or cold air for drying the samples.

An operator may set the apparatus so that any desired number of six platens 40 in the platen rack 20 are used to polish the samples S. Normally, the coarsest polishing platen is stored in the lowest position or position no. 1 and the platens gradually have finer and finer surfaces as you move up in the rack so the finest polishing surface would be on the platen stored in the uppermost position no. 6 at the top of the platen rack 20.

The cycle described above was by way of example only. In one preferred embodiment, the starting position for the polishing head 100 is the position shown in FIG. 3 where the head is positioned over the wash tank 24, and the starting position for the platen exchange mechanism 50 is position zero as shown in FIG. 6.

In the preferred embodiment disclosed herein, the platen drive plate shown at 22 in FIG. 1 is intended to be rotated only in a counterclockwise direction by motor 300 and gear box 302. However, the manifold 142 (see FIG. 4) is designed to be rotated either in a clockwise or a counterclockwise direction by motor 122 and gear box 124. As a result, the sample holder 190 or 200 may be rotated either in the same or the opposite direction that the platen 40 is rotated during a polishing operation.

In the preferred embodiment being described, the sample holder 190 or 200 can be rotated at 30 rpm, 60 rpm or 120 rpm, and the platen drive plate 22 can be rotated at any desired speed from 25 rpm to 350 rpm. The downward pressure which the individual pistons 180 apply to corresponding samples can be varied from one pound to twenty pounds. The down force of the pistons may be determined by electronic pneumatic control.

As is known in the art, limit switches are preferably used to control the position of various components. For example, FIG. 2 shows a head rotation limit switch 350 for controlling the rotary position of head 100, and also a pair of left and right limit switches 352 and 354 for controlling the horizontal movement of bearing carriage assembly 82. FIG. 2 further shows a platen position sensor 360.

The time of a complete cycle may vary depending on various factors. However, the entire polishing and cleaning procedure for polishing six samples will normally take in the range of only 15 to 20 minutes.

Finally, it will be understood that microprocessor controls are preferably utilized to control the various operations described herein. Such microprocessor controls are known in the art and do not form a part of the present invention.

What we claim is:

1. A sample preparation system for grinding and polishing metallurgical and other samples prior to microscopic examination thereof, said system including, in combination, a platen rack having a plurality of shelves arranged vertically one above the other, each shelf having a support surface for supporting a polishing platen thereon in a horizontal position, platen exchange means for selecting one platen from said rack and transferring the same to a platen drive plate for conjoint rotation with said drive plate for a polishing operation, where said platen exchange means is movable horizontally from a position behind said rack so as to move directly through said rack between a pair of adjacent shelves thereof to remove and transfer a selected platen from said rack to said platen drive plate, and a polishing head which is movable between a polishing position where it is located over said platen drive plate and a wash position where it is located over a wash station, said polishing head having means to support a sample holder therebeneath so that said sample holder may be positioned down against a platen on said drive plate for polishing samples held in said sample holder, means associated with said polishing head for raising and lowering said sample holder and for rotating the same, and said platen exchange means being operated when said polishing head is positioned over said wash station.

2. A sample preparation system as defined in claim 1 where said platen exchange means includes a transfer arm which is movable both vertically and horizontally, said transfer arm being movable vertically to align with a platen to be transferred from said rack.

3. A sample preparation system as defined in claim 2 where said transfer arm is moved vertically by a motor-driven vertical feed screw and is driven horizontally by a motor-driven horizontal feed screw.

4. A sample preparation system as defined in claim 2 where said transfer arm includes an arm member having two spaced lift arms extending horizontally therefrom, said lift arms serving to carry a selected platen, and said arm member including means for engaging and pushing a selected platen off its platen rack support surface and onto said lift arms for transfer of said platen when said transfer arm moves directly through said rack.

5. A sample preparation system as defined in claim 4 where each of said shelves has a trough at each side of each said platen support surface, said troughs being spaced so that the side edges of a platen positioned on said support surface will overlie said troughs, and said lift arms being spaced to move through said troughs and beneath said side edges of said platen when said transfer arm moves directly through said rack so that said means for engaging will cause said platen to be pushed off said support surface onto said lift arms.

6. A sample preparation system as defined in said claim 5 where each said platen support surface has stop means located at the rear end of said surface whereby when said transfer arm moves through said platen rack from the forward side thereto to the rearward side thereof, a platen carried on said lift arms will be stopped and caused to rest on said support surface in a storage position while said transfer arm continues to move rearwardly of said rack.

7. A sample preparation system as defined in claim 2 where said rack includes an upright support plate and one side of each of said shelves is attached to said support plate in cantilever fashion so that said transfer arm may move horizontally in either direction between the free ends of said shelves.

8. A sample preparation system as defined in claim 1 where said platen rack is disposed on one side of said platen drive plate and said wash station is disposed on the opposite side of said platen drive plate.

9. A sample preparation system for grinding and polishing metallurgical and other samples prior to microscopic examination thereof, said system including, in combination, a platen rack having a plurality of shelves arranged vertically one above the other, each shelf having a support surface for supporting a polishing platen thereon in a horizontal position, platen exchange means for selecting one platen from said rack and transferring the same to a platen drive plate for conjoint rotation with said drive plate for a polishing operation, and a polishing head which is movable between a polishing position where it is located over said platen drive plate and a wash position where it is located over a wash station, said polishing head having means to support a sample holder therebeneath so that said sample holder may be positioned down against a platen on said drive plate for polishing samples held in said sample holder, means associated with said polishing head for raising and lowering said sample holder and for rotating the same, and said platen exchange means being operated when said polishing head is positioned over said wash station, said platen exchange means including a transfer arm which is movable both vertically and horizontally, said transfer arm being movable vertically to align with a platen to be transferred from said rack, and being movable horizontally from a position behind said rack so as to move directly through said rack between a pair of adjacent shelves thereof to remove and transfer a selected platen to said platen drive plate, said transfer arm including an arm member having two lift arms extending horizontally therefrom, said lift arms serving to carry a selected platen, and said arm member including means for engaging and pushing a selected platen off its rack support surface and onto said lift arms for transfer of said platen, said platen rack including an upright support plate and one side of each of said shelves being attached to said support plate in cantilever fashion so that said transfer arm may move horizontally in either direction between the free ends of said shelves, and said platen rack being disposed on one side of said platen drive plate and said wash station being disposed on the opposite side of said platen drive plate.

10. A sample preparation system as defined in claim 9 where said transfer arm is moved vertically by a motor-driven vertical feed screw and is driven horizontally by a motor-driven horizontal feed screw, and where each of said shelves has a trough at each side of each said platen support surface, said troughs being spaced so that the side edges of a platen positioned on said support surface will overlie said troughs, and said lift arms being spaced to move through said troughs and beneath said side edges of said platen when said transfer arm moves directly through said rack so that said means for engaging will cause said platen to be pushed off said support surface onto said lift arms.

11. A sample preparation system as defined in claim 10 where each said platen support surface has stop means located at the rear end of said surface whereby when said transfer arm moves through said platen rack from the forward side thereof to the rearward side thereof, a platen carried on said lift arms will be stopped and caused to rest on said support surface in a storage position while said transfer arm continues to move rearwardly of said rack.

* * * * *